US007461502B2

(12) United States Patent
Emsellem

(10) Patent No.: US 7,461,502 B2
(45) Date of Patent: Dec. 9, 2008

(54) SPACECRAFT THRUSTER

(75) Inventor: Gregory Emsellem, Chapet (FR)

(73) Assignee: Elwing LLC, Wilmington, DE (US)

( * ) Notice: Subject to any disclaimer, the term of this patent is extended or adjusted under 35 U.S.C. 154(b) by 242 days.

(21) Appl. No.: 11/230,129

(22) Filed: Sep. 19, 2005

(65) Prior Publication Data

US 2007/0234705 A1 Oct. 11, 2007

Related U.S. Application Data

(63) Continuation of application No. PCT/US2004/008054, filed on Mar. 17, 2004.

(51) Int. Cl.
*F03H 1/00* (2006.01)

(52) U.S. Cl. ..... 60/202

(58) Field of Classification Search ..... 60/202, 60/203.1; 313/359.1, 362.1; 315/111.41, 315/111.61

See application file for complete search history.

(56) References Cited

U.S. PATENT DOCUMENTS

| | | | | |
|---|---|---|---|---|
| 3,016,693 A | | 1/1962 | Jack et al. | |
| 3,119,233 A | | 1/1964 | Wattendorf et al. | |
| 3,122,882 A | | 3/1964 | Schultz et al. | |
| 3,160,566 A | | 12/1964 | Dandl et al. | |
| 3,209,189 A | | 9/1965 | Patrick | |
| 3,257,579 A | | 6/1966 | Delcroix et al. | |
| 3,279,175 A | | 10/1966 | Hendel et al. | |
| 3,304,719 A | | 2/1967 | Ducati | |
| 3,425,902 A | | 2/1969 | Consoli et al. | |
| 3,512,362 A | | 5/1970 | Daley | |
| 3,571,734 A | | 3/1971 | Consoli et al. | |
| 3,778,656 A | * | 12/1973 | Fremiot et al. | 313/363.1 |
| 3,956,885 A | | 5/1976 | Davis et al. | |
| 4,305,247 A | | 12/1981 | Ellion et al. | |
| 4,328,667 A | | 5/1982 | Valentian | |

(Continued)

FOREIGN PATENT DOCUMENTS

FR 2782884 3/2000

(Continued)

OTHER PUBLICATIONS

Satori, "Electron Cyclotron Resonance Ion Source for Ion Thruster", Jpn. J. Appl. Phys. vol. 35, pp. 274-275 (1996).

(Continued)

*Primary Examiner*—Ted Kim
(74) *Attorney, Agent, or Firm*—Harness, Dickey & Pierce, P.L.C.

(57) ABSTRACT

A thruster has a chamber defined within a tube. The tube has a longitudinal axis which defines an axis of thrust; an injector injects ionizable gas within the tube, at one end of the chamber. A magnetic field generator with two coils generates a magnetic field parallel to the axis; the magnetic field has two maxima along the axis; an electromagnetic field generator has a first resonant cavity between the two coils generating a microwave ionizing field at the electron cyclotron resonance in the chamber, between the two maxima of the magnetic field. The electromagnetic field generator has a second resonant cavity on the other side of the second coil. The second resonant cavity generates a ponderomotive accelerating field accelerating the ionized gas. The thruster ionizes the gas by electron cyclotron resonance, and subsequently accelerates both electrons and ions by the magnetized ponderomotive force.

29 Claims, 6 Drawing Sheets

U.S. PATENT DOCUMENTS

| | | | |
|---|---|---|---|
| 4,417,178 | A | 11/1983 | Geller et al. |
| 4,641,060 | A | 2/1987 | Dandl |
| 4,663,932 | A | 5/1987 | Cox |
| 4,815,279 | A | 3/1989 | Chang |
| 4,893,470 | A | 1/1990 | Chang |
| 4,952,273 | A | 8/1990 | Popov |
| 5,241,244 | A | 8/1993 | Cirri |
| 5,442,185 | A | 8/1995 | Chan |
| 5,581,155 | A | 12/1996 | Morozov et al. |
| 5,947,421 | A | 9/1999 | Beattie et al. |
| 6,193,194 | B1 | 2/2001 | Minovitch |
| 6,205,769 | B1 | 3/2001 | Brandenburg et al. |
| 6,293,090 | B1 | 9/2001 | Olson |
| 6,334,302 | B1 | 1/2002 | Chang-Diaz |
| 6,516,604 | B2 | 2/2003 | Mojarradi et al. |
| 6,523,338 | B1 | 2/2003 | Kornfeld et al. |

FOREIGN PATENT DOCUMENTS

| | | | |
|---|---|---|---|
| FR | 2788084 | | 7/2000 |
| FR | 2799576 | | 4/2001 |
| WO | WO00/01206 | * | 1/2000 |
| WO | WO 03/039215 A1 | | 8/2003 |

OTHER PUBLICATIONS

Genovese et al., "FEEP Thruster Performance at High Background Pressure", Electric Rocket Propulsion Society (1997).
Schoenberg et al., "Magnetohydrodynanaic flow physics of magnetically nozzled plasma accelerators with applications to advanced manufacturing", Physics of Plasmas, vol. 5, No. 5, pp. 2090-2104 (May 1998).
Choueiri, "On the Thrust of Self-Field MPD Thrusters", IEPC-97-072, 25th International Electric Propulsion Conference, Cleveland, OH (1997).
Choueiri, "The Scaling of Thrust in Self-Field Magnetoplasmadynamic", Journal of Propulsion and Power, vol. 14, No. 5, pp. 744-753, AIAA, (Sep.-Oct. 1998).
Ziemer et al., "Dimensionless Performance Model for Gas-Fed Pulsed Plasma Thrusters", AIAA-98-3661, 34th Joint Propulsion Conference (1998).
Markusic et al., "Ablative Z-Pinch Pulsed Plasma Thruster", AIAA-2000-3257, 36th Joint Propulsion Conference (2000).
Chen, "RF production of high density plasmas for accelerators", Laser and Particle Beams, vol. 7, Part 3, pp. 551-559 (1989).
Davies, "Helicon wave propagation: effect of electron inertia", J. Plasma Physics, vol. 4, Part 1, pp. 43-50 (1970).
Boswell et al., "Multipole confined diffusion plasma produced by 13.56 MHz electrodeless source", J. Vac. Sci. Technol. A 7 (6) (Nov./Dec. 1989).
Zhu et al. Observation of nonthermal electron tails in an rf excited argon magnetoplasma,: Phys. Fluids B 3 (4), (Apr. 1991).
Perry et al., Fast anistropic etching of silicon in an inductively coupled plasma reactor,: Appl. Phys. Lett. 55 (2) (Jul. 10, 1989).
Shoji et al., "Plasma production by helicon waves", Plasma Sources Sci. Technol., vol. 2, pp. 5-10 (1993).
Komori et al., "Helicon waves and efficient plasma production", Phys. Fluids B 3 (4) (Apr. 1991).
Popov (Editor), "High Density Plasma Sources: Design, Physics and Performance", Noyes Publications (1995).
Jahn, "Physics of Electric Propulsion", McGraw-Hill Series in Missile and Space Technology (1968).
Kunkel (Editor), "Plasma Physics in Theory and Application", McGraw-Hill (1966).
Galeev et al., "Basic Plasma Physics", Selected Chapters from the Handbook of Plasma Physics, North-Holland (1989).
Linhart, "Plasma Physics", North-Holland (1960).
Kash (Editor), "Plasma Acceleration: 4th Lockheed Symposium on Magnetohydrodynamics", Standford University Press (1960).
Bromaghim et al., "Review of the Electric Propulsion Space Experiment (ESEX) Program",Journal of Propulsion and Power, vol. 18, No. 4 (Jul.-Aug. 2002).
Mueller et al., "Microwave Waveguide Helium Plasmas for Electrothermal Propulsion", Journal of Propulsion and Power, vol. 8, No. 5 (Sep.-Oct. 1992).
Olson, "A more Efficient Radio Frequency Plasma Thruster", 35th AIAA/ASME/SAE/ASEE Joint Propulsion Conference and Exhibit (Jun. 20-24, 1999).
Hooper, "Plasma Detachment from a Magnetic Nozzle", Journal of Propulsion and Power, vol. 9, No. 5 (Sep.-Oct. 1993).
Miller et al., "Cyclotron Resonance Thruster Design Techniques", AIAA Journal, vol. 4, No. 5, AIAA (May 1966).
Miller et al., "Cyclotron Resonance Propulsion System", 3rd Symp. Eng. Aspects of MagnetoHydroDynamics, pp. 405-411 (1963).
Kaufman et al., "Experimental Studies of an ECR Plasma Thruster", AIAA/SAE/ASME/ASEE 29th Joint Propulsion Conference and Exhibit (Jun. 28-30, 1993).
Tahara et al., "Ground Simulation Experiment of Plasma Environment around Spacecraft at Osaka University", 30th Plasmadynamics and Lasers Conference, AIAA (Jun. 28-Jul. 1, 1999).
Ilin et al., "Simulations of Plasma Detachment in VASIMR", 40th AIAA Aerospace Sciences Meeting & Exhibit (Jan. 14-17, 2002).
Toki et al., "Performance Test of Various Discharge Chamber Configurations for ECR Discharge Ion Thruster", 27th IEPC (Oct. 15-19, 2001).
Marcuccio et al., "FEEP Microthruster Technology Status and Potential Application", International Astronautical Federation (1977).
Boswell, "Very Efficient Plasma Generation By Whistler Waves Near The Lower Hybrid Frequency", Plasma Physics and Controlled Fusion, vol. 26, No. 10, pp. 1147-1162 (1984).
Bose et al., "Two-Temperature Elenbaas-Heller Problem with Arfon Plasma", Plasma Physics and Controlled Fusion, vol. 26, No. 10, pp. 1163-1165 (1984).
Fisch et al., "Current Drive By Lower Hybrid Waves in the Presence of Energetic Alpha Particles", Nuclear Fusion, vol. 32, No. 4, pp. 549-556 (1992).
Chen, "Plasma Ionization by Helicon Waves", Plasma Physics and Controlled Fusion, vol. 33, No. 4, pp. 339-364 (1991).
Petržílka, "On Lower Hybrid Wave Scattering on Self-Consistent Plasma Density Modulations Produced by Ponderomotice Forces", Plasma Physics and Controlled Fusion, vol. 33, No. 4, p. 365.
Consoli, "Accélération de plasma par des gradients de champ électromagnétique et magnetique statique", C.R. Acad Sc. Paris, t. 257, pp. 2440-2443 (Oct. 1963).
Consoli, "Premiére vérification expérimentale de l'accélération d'un plasma par des gradients de champ II. F. et magnétique statique", C.R. Acad Sc. Paris, t. 257, pp. 2804-2807 (Nov. 1963).
Bardet et al., "Accélérateurs à plasma à ondes prgressives. Étude théorique", C.R. Acad Sc. Paris, t. 258, pp. 4454-4457 (May 1964).
Consoli et al., "Accumulation de plasma énergétique au moyen de deux structures simultanément Accélératrices et bouchons dynamiques", C.R. Acad Sc. Paris, t. 259, pp. 1044-1047 (Aug. 1964).
Bardet et al., "Caractéristiques du plasma accéléré dans la machine", C.R. Acad Sc. Paris, t. 259, pp. 2190-2193 (Oct. 1964); and Bardet et al., "Thérie du <<bouchon dynamique>> à gradients de champs haute fréquence et magnétique statique", C.R. Acad Sc. Paris, t. 259, pp. 2388-2391 (Oct. 1964).
Consoli et al., "Acceleration de Plasma par des Gradients de Champs Electromagnetique et Magnetique Statique", Fusion Nucleaire 3, pp. 237-247 (1963).
Bardet et al., "Résultats Expérimentaux Sur L'Accélération De Plasma Par Les Gradients Des Champs Magnétique Statique Et Electromagnétique", Nuclear Fusion 4 (1964).
Bardet et al., "Acceleration Continue De Plasma A Gradients De Champs Electromagnetique Et Magnetique Statique Resultats Experimentaux", Physics Letters, vol. 10, No. 1 (1964).
Bardet et al., "Mecanisme Physique De L'Entrainment Des Ions Par La Charge D'Espace Des Electrons Dans L'Acceleration Par Les Gradients De Champs Magnetique Statique Et Electromagnetique", Fusion Nucleaire 5 (1965).
Bardet et al., "Réactions D-T obtenues avec une structure mixte, en régime d'accéléeration", C.R. Acad. Sc. Paris, t. 262, pp. 1325-1328 (May 1966).

Bardet et al., "Flux Des Ions Dt Avec Le Dispositif Pleiade", Fusion Nucleaire 6 (1966).

Abgrall et al., "Mise en évidence expérimental de la zone d'accélération des ions après jumelage de deux accélérateurs à haute fréquence et gradient de champ magnétique", C.R. Acad Sc. Paris, t. 264, pp. 762-765 (Oct. 1967).

Briand et al., "Spectre D'Energie Des Ions D'Un Plasma D'Alumine Cree Par Laser", Physics Letters, vol. 25A, No. 8 (1967).

Briand et al., "Fonctionnement d'un accélérateur à champ haute fréquence avec une préionisation par laser", C.R. Acad Sc. Paris, t. 265, pp. 900-903 (Oct. 1967).

Consoli, "Accélération et refléxion symétriques de jets intenses de plasma dans une même structure haute fréquence", C.R. Acad Sc. Paris, t. 260, pp. 4163-4166 (Apr. 1965).

Consoli, "Pieges A Plasma Sans Fuites", Physics letters, vol. 7, No. 4, pp. 1-2 (Dec. 1963).

Consoli, "Les champs H.F. et les Accélérateurs a plasma", BIST 102/3, pp. 35-49 (1966).

Consoli, "Etudes Theoriques et Experimentales Sur Les Interactions Ondes et plasma a la Resonance Cyclotron Dans Un Miroir Magnetique", IAEA (1968).

Consoli, "Recherches sur l'accélération, la réflexion et le confinement d'ions par le champ de charge d'espace créé par des electrons à grande énergie perpendiculaire", Extrait de Bulletin d'Informations Scientifiques et Techniques du Commissariat a l'Energie Atomique No. 128 (1968).

Consoli, Accélération et confinement d'ions par des électrons, Eurospectra Revue de la Commanauté Européenne de l'Energie Atomique, pp. 87-93 (1968).

Emsellem, "Etude théorique préliminaire d'un propulseur radiofréquence à gradient de champs électromagnétique" (Preliminary theoretical study of a radiofrequency thruster with electromagentic field gradient), internship report for the master degree in Plasma Physics, University Paris XI—Orsay, Apr. 27-Jun. 30, 2000.

Emsellem, "Presentation de l'Invention", (2002).

European Search Report dated Sep. 15, 2003, 2 pages.

* cited by examiner

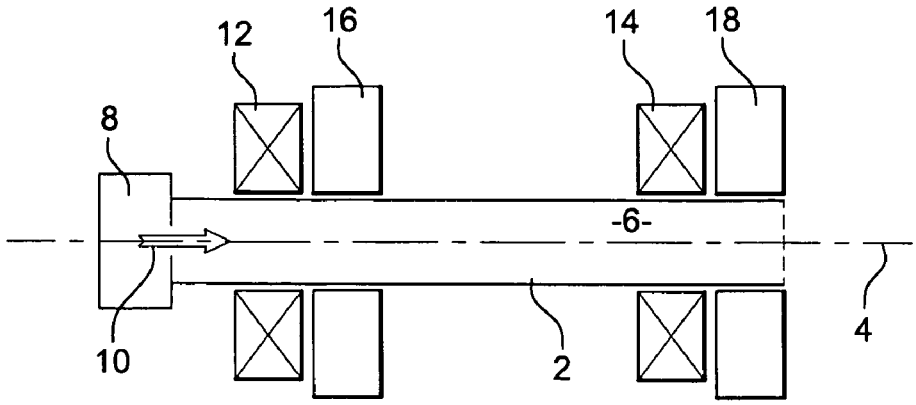
Fig. 1
Fig. 2
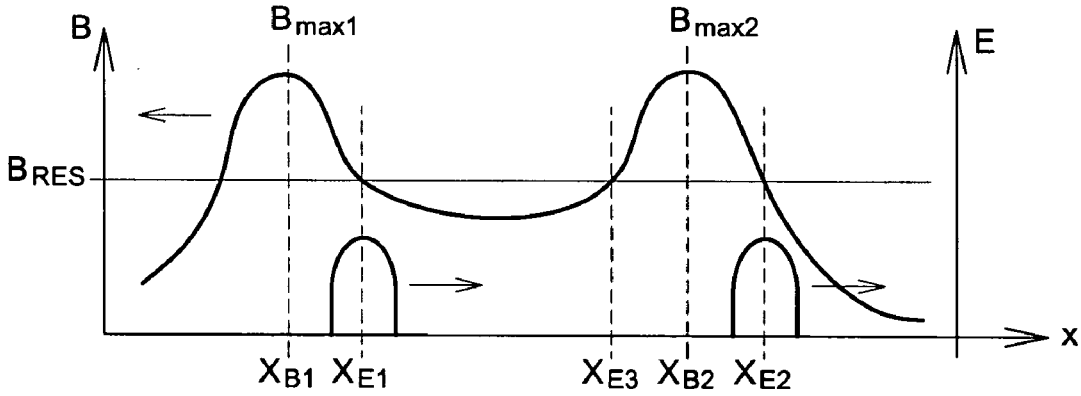
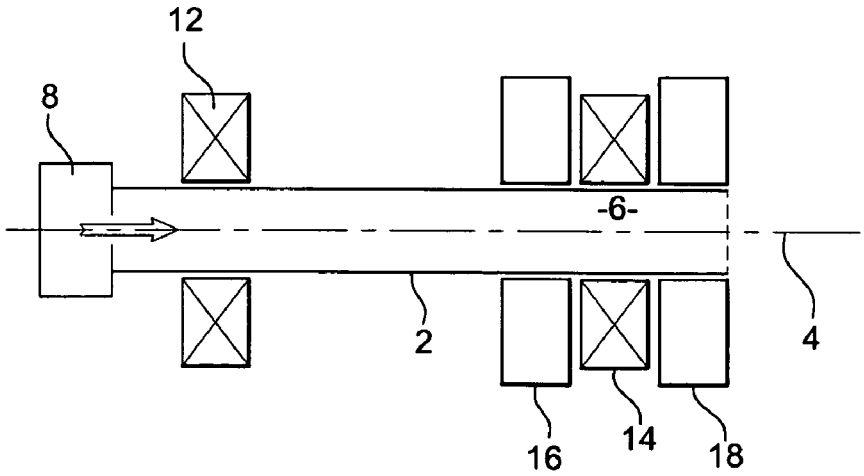
Fig. 3

SPACECRAFT THRUSTER

CROSS REFERENCE TO RELATED APPLICATIONS

This application is a continuation of PCT/US2004/008054, filed Mar. 17, 2004, which claims priority to European Patent Application No. EP 03290712.3, filed Mar. 20, 2003, both of which are incorporated by reference herein.

BACKGROUND AND SUMMARY OF THE INVENTION

The invention relates to the field of thrusters. Thrusters are used for propelling spacecrafts, with a typical exhaust velocity ranging from 2 km/s to more than 50 km/s, and density of thrust below or around 1 N/m$^2$. In the absence of any material on which the thruster could push or lean, thrusters rely on the ejection of part of the mass of the spacecraft. The ejection speed is a key factor for assessing the efficiency of a thruster, and should typically be maximized.

Various solutions were proposed for spatial thrusters. U.S. Pat. No. 5,241,244 discloses a so-called ionic grid thruster. In this device, the propelling gas is first ionized, and the resulting ions are accelerated by a static electromagnetic field created between grids. The accelerated ions are neutralized with a flow of electrons. For ionizing the propelling gas, this document suggests using simultaneously a magnetic conditioning and confinement field and an electromagnetic field at the ECR (electron cyclotron resonance) frequency of the magnetic field. A similar thruster is disclosed in FR-A-2 799 576, induction being used for ionizing the gas. This type of thruster has an ejection speed of some 30 km/s, and a density of thrust of less than 1N/m$^2$ for an electrical power of 2,5 kW. One of the problems of this type of device is the need for a very high voltage between the accelerating grids. Another problem is the erosion of the grids due to the impact of ions. Last, neutralizers and grids are generally very sensitive devices.

U.S. Pat. No. 5,581,155 discloses a Hall Effect Thruster. This thruster also uses an electromagnetic field for accelerating positively-charged particles. The ejection speed in this type of thruster is around 15 km/s, with a density of thrust of less than 5 N/m$^2$ for a power of 1,3 kW. Like in ionic grid thruster, there is a problem of erosion and the presence of neutralizer makes the thruster prone to failures.

U.S. Pat. No. 6,205,769 or D. J. Sullivan et al., Development of a microwave resonant cavity electrothermal thruster prototype, IEPC 1993, n°36, pp. 337-354 discuss microwave electrothermal thrusters. These thrusters rely on the heating of the propelling gas by a microwave field. The heated gas is ejected through a nozzle to produce thrust. This type of thruster has an ejection speed of some 9-12 km/s, and a thrust from 200 to 2000 N.

D. A. Kaufman et al., Plume characteristic of an ECR plasma thruster, IEPC 1993n°37, pp. 355-360 and H. Tabara et al., Performance characteristic of a space plasma simulator using an electron cyclotron resonance plasma accelerator and its application to material and plasma interaction research, IEPC 1997n° 163, pp. 994-1000 discuss ECR plasma thrusters. In such a thruster, a plasma is created using electron cyclotron resonance in a magnetic nozzle. The electrons are accelerated axially by the magnetic dipole moment force, creating an electric field that accelerates the ions and produces thrust. In other words, the plasma flows naturally along the field lines of the decreasing magnetic field. This type of thruster has an ejection speed up to 35 km/s. U.S. Pat. No. 6,293,090 discusses a RF plasma thruster; its works according to the same principle, with the main difference that the plasma is created by a lower hybrid wave, instead of using an ECR field.

U.S. Pat. No. 6,334,302, U.S. Pat. No. 4,893,470 or Dr. Franklin R. Chang-Diaz, Design characteristic of the variable $I_{sp}$ plasma rocket, IEPC 1991, n° 128, disclose variable specific impulse magnetoplasma thruster (in short VaSIMR). This thruster uses a three stage process of plasma injection, heating and controlled exhaust in a magnetic tandem mirror configuration. The source of plasma is a helicon generator or MagnetoPlasmaDynamic (MPD) Thruster and the plasma heater is a cyclotron generator working at Ion Cyclotron Frequency. The "hybrid plume", composed of hot plasma core surrounded by cold gas is contained in a nozzle which is protected from the hot plasma by the cold gas blanket. This thermal expansion in a nozzle converts a part of the internal energy into directed thrust. As in ECR or RF plasma thruster, ionized particles are not accelerated, but initially flow along the lines of the decreasing magnetic field and then along the gradient of pressure. This type of thruster has an ejection speed of some 10 to 300 km/s, and a thrust of 50 to 1000 N.

In a different field, U.S. Pat. No. 4,641,060 and U.S. Pat. No. 5,442,185 discuss ECR plasma generators, which are used for vacuum pumping or for ion implantation. Another example of a similar plasma generator is given in U.S. Pat. No. 3,160,566.

U.S. Pat. No. 3,571,734 discusses a method and a device for accelerating particles. The purpose is to create a beam of particles for fusion reactions. Gas is injected into a cylindrical resonant cavity submitted to superimposed axial and radial magnetic fields. An electromagnetic field at the ECR frequency is applied for ionizing the gas. The intensity of magnetic field decreases along the axis of the cavity, so that ionized particles flow along this axis. This accelerating device is also discloses in the Compte Rendu de I'Academie des Sciences, Nov. 4, 1963, vol. 257, p. 2804-2807. The purpose of these devices is to create a beam of particles for fusion reactions: thus, the ejection speed is around 60 km/s, but the density of thrust is very low, typically below 1,5 N/m$^2$.

U.S. Pat. No. 3,425,902 discloses a device for producing and confining ionized gases. The magnetic field is maximum at both ends of the chamber where the gases are ionized.

Thus, there is a need for a thruster, having a good ejection speed, which could be easily manufactured, be robust and resistant to failures. This defines an electrode-less device accelerating both particles to high speed by applications of a directed body force.

The invention therefore provides, in one embodiment a thruster, having a chamber defining an axis of thrust;

an injector adapted to inject ionizable gas within the chamber;

a magnetic field generator adapted to generate a magnetic field, said magnetic field having at least a maximum along the axis;

an electromagnetic field generator adapted to generate a microwave ionizing field in the chamber (6), on one side of said maximum; and a magnetized ponderomotive accelerating field on the other side of said maximum.

The thruster may also present one or more of the following features:

the angle of the magnetic field with the axis is less than 45°, preferably less than 20°;

the frequency of the electromagnetic field is within 10% of the electron cyclotron resonance frequency at the location where the electromagnetic field is generated;

the ratio of the maximum value to the minimum value of the magnetic field is between 1,1 and 20;

the angle of the electric component of the electromagnetic field with the orthoradial direction is less than 45°, preferably less than 20°;

the local angle between the electric component of electromagnetic field and the magnetic field in the thruster is between 60 and 90°;

the ion cyclotron resonance period in the thruster is at least twice higher than the characteristic collision time of the ions in the thrusters;

the microwave ionizing field and the magnetic field are adapted to ionize at least 50% of the gas injected in the chamber;

the magnetic field generator comprises at least one coil located along the axis substantially at the maximum of magnetic field;

the magnetic field generator comprises a second coil located between said at least one coil and said injector;

the magnetic field generator is adapted to vary the value of said maximum;

the magnetic field generator is adapted to vary the direction of said magnetic field, at least on said other side of said maximum;

the electromagnetic field generator comprises at least one resonant cavity;

the electromagnetic field generator comprises at least one resonant cavity on said one side of said maximum;

the electromagnetic field generator comprises at least one resonant cavity on said other side of said maximum;

the chamber is formed within a tube;

the tube has an increased section at its end opposite the injector;

the thrusters comprises a quieting chamber between the injector and the chamber.

The invention further provides a process for generating thrust, comprising:

injecting a gas within a chamber;

applying a first magnetic field and a first electromagnetic field for ionizing at least part of the gas;

subsequently applying to the gas a second magnetic field and a second electromagnetic field for accelerating the partly ionized gas due to the magnetized ponderomotive force.

The process may further be characterized by one of the following features:

the gas is ionized by electron cyclotron resonance and accelerated by magnetized ponderomotive force;

the ions are mostly insensitive to the first magnetic field;

the local angle between the first electric component of electromagnetic field and the first magnetic field is between 60 and 90°;

the local angle between the electric component of second electromagnetic field and the second magnetic field is between 60 and 90°;

at least 50% of the gas is ionized;

the direction of the second magnetic field is varied.

BRIEF DESCRIPTION OF THE DRAWINGS

A thruster embodying the invention will now be described, by way of non-limiting example, and in reference to the accompanying drawings, where:

FIG. 1 is a schematic view in cross-section of a thruster in a first embodiment of the invention;

FIG. 2 is a diagram of the intensity of magnetic and electromagnetic fields along the axis of the thruster of FIG. 1;

FIG. 3 is a schematic view in cross-section of a thruster in a second embodiment of the invention;

DETAILED DESCRIPTION

Figure 4:
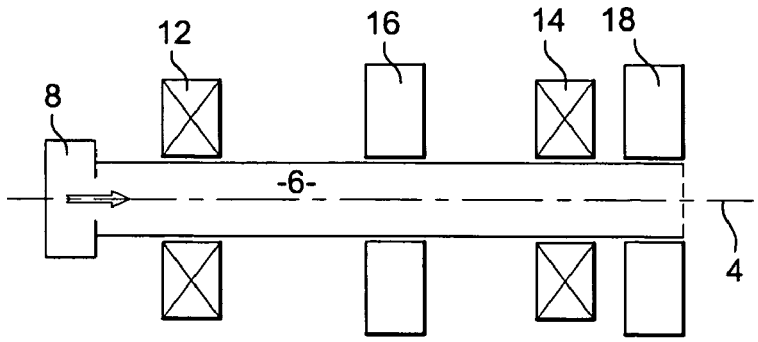
FIG. 4 is a schematic view in cross-section of a thruster in a third embodiment of the invention.

FIG. 1 is a schematic view in cross-section of a thruster according to a first embodiment of the invention. The thruster of FIG. 1 relies on electron cyclotron resonance for producing a plasma, and on magnetized ponderomotive force for accelerating this plasma for producing thrust. The ponderomotive force is the force exerted on a plasma due to a gradient in the density of a high frequency electromagnetic field. This force is discussed in H. Motz and C. J. H. Watson (1967), *Advances in electronics and electron physics* 23, pp.153-302. In the absence of a magnetic field, this force may be expressed as $$F = -\frac{q^2}{4m\omega^2}\nabla E^2$$

for one particule $$F = -\frac{\omega_p^2}{2\omega^2}\nabla\frac{\varepsilon_0 E^2}{2}$$

for the plasma with $$\omega_p^2 = \frac{ne^2}{m_e\varepsilon_0}$$

In presence of a non-uniform magnetic field this force can be expressed as:

$$F = -\frac{q^2}{4m\omega}\left(\frac{\nabla E^2}{(\omega-\Omega_c)} - \frac{E^2}{(\omega-\Omega_c)^2}\nabla\Omega_c\right) - \mu\nabla B$$

The device of FIG. 1 comprises a tube 2. The tube has a longitudinal axis 4 which defines an axis of thrust; indeed, the thrust produced by the thruster is directed along this axis—although it may be guided as explained below in reference to FIGS. 10 to 13. The inside of the tube defines a chamber 6, in which the propelling gas is ionized and accelerated.

In the example of FIG. 1, the tube is a cylindrical tube. It is made of a non-conductive material for allowing magnetic and electromagnetic fields to be produced within the chamber; one may use low permittivity ceramics, quartz, glass or similar materials. The tube may also be in a material having a high rate of emission of secondary electrons, such as BN, $Al_2O_3$, $_{B4}C$. This increases electronic density in the chamber and improves ionization.

The tube extends continuously along the thruster, gas being injected at one end of the tube. One could however contemplate various shapes for the tube. For instance, the cross-section of the tube, which is circular in this example, could have another shape, according to the plasma flow needed at the output of the thruster. An example of another possible cross-section is given below in reference to FIG. 14. Also, there is no need for the tube to extend continuously between the injector and the output of the thruster (in which case the tube can be made of metals or alloys such as steel, W, Mo, Al, Cu, Th—W or Cu—W, which can also be impregnated or coated with Barium Oxide or Magnesium Oxide, or include radioactive isotope to enhance ionization): as discussed below, the plasma are not confined by the tube, but rather by the magnetic and electromagnetic fields applied in the thruster. Thus, the tube could comprise two separate sections, while the chamber would still extend along the thruster, between the two sections of the tube.

At one end of the tube is provided an injector 8. The injector injects ionizable gas into the tube, as represented in FIG. 1 by arrow 10. The gas may comprise inert gazes Xe, Ar, Ne, Kr, He, chemical compounds as $H_2$, $N_2$, $NH_3$, $N_2H_2$, $H_2O$ or $CH_4$ or even metals like Cs, Na, K or Li (alkali metals) or Hg. The most commonly used are Xe and $H_2$, which need the less energy for ionization.

The thruster further comprises a magnetic field generator, which generates a magnetic field in the chamber 6. In the example of FIG. 1, the magnetic field generator comprises two coils 12 and 14. These coils produce within chamber 6 a magnetic field B, the longitudinal component of which is represented on FIG. 2. As shown on FIG. 2, the longitudinal component of the magnetic field has two maxima, the position of which corresponds to the coils. The first maximum $B_{max1}$, which corresponds to the first coil 12, is located proximate the injector. It only serves for confining the plasma, and is not necessary for the operation of the thruster. However, it has the advantage of longitudinally confining the plasma electrons, so that ionization is easier by a magnetic bottle effect; in addition, the end of the tube and the injector nozzle are protected against erosion. The second maximum $B_{max2}$, corresponding to the second coil 14, makes it possible to confine the plasma within the chamber. It also separates the ionization volume of the thruster—on one side of the maximum from the acceleration volume—on the other side of the maximum. The value of the longitudinal component of the magnetic field at this maximum may be adapted as discussed below. Between the two maxima—or on the side of the second maximum where the gas is injected, the magnetic field has a lower value. In the example of FIG. 1, the magnetic field has a minimum value $B_{min}$ substantially in the middle of the chamber.

In the ionization volume of the thruster—between the two maxima of the magnetic field in the example of FIG. 1—the radial and orthoradial components of the magnetic field—that is the components of the magnetic field in a plane perpendicular to the longitudinal axis of the thruster—are of no relevance to the operation of the thruster; they preferably have a smaller intensity than the longitudinal component of the magnetic field. Indeed, they may only diminish the efficiency of the thruster by inducing unnecessary motion toward the walls of the ions and electrons within the chamber.

In the acceleration volume of the thruster—that is one right side of the second maximum $B_{max2}$ of the magnetic field in the example of FIG. 1—the direction of the magnetic field substantially gives the direction of thrust. Thus, the magnetic field is preferably along the axis of the thrust. The radial and orthoradial components of the magnetic field are preferably as small as possible.

Thus, in the ionization volume as well as in the acceleration volume, the magnetic field is preferably substantially parallel to the axis of the thruster. The angle between the magnetic field and the axis 4 of the thruster is preferably less than 45°, and more preferably less than 20°. In the example of FIGS. 1 and 2, this angle is substantially 0°, so that the diagram of FIG. 2 corresponds not only to the intensity of the magnetic field plotted along the axis of the thruster, but also to the axial component of the magnetic field.

The intensity of the magnetic field generated by the magnetic field generator—that is the values $B_{max1}$, $B_{max2}$ and $B_{min}$—are preferably selected as follows. The maximum values are selected to allow the electrons of the plasma to be confined in the chamber; the higher the value of the mirror ratio $B_{max}/B_{min}$, the better the electrons are confined in the chamber. The value may be selected according to the (mass flow rate) thrust density wanted and to the power of the electromagnetic ionizing field (or the power for a given flow rate), so that 90% or more of the gas is ionized after passing the second peak of magnetic field. The lower value $B_{min}$ depends on the position of the coils. It does not have much relevance, except in the embodiment of FIGS. 4 and 5. The fraction of electron lost from the bottle in percent can be expressed as:

$$\alpha_{lost} = 1 - \sqrt{1 - \frac{B_{\min}}{B_{\max}}} \quad \text{or} \quad \frac{B_{\max}}{B_{\min}} = \frac{1}{1-(1-\alpha_{lost})^2}$$

For a given mass flow, and for a given thrust, a smaller $\alpha_{lost}$ allows reducing the ionizing power for the same flow rate and ionization fraction.

In addition, the magnetic field is preferably selected so that ions are mostly insensitive to the magnetic field. In other words, the value of the magnetic field is sufficiently low that the ions of the propelling gas are not or substantially not deviated by the magnetic field. This condition allows the ions of the propelling gas to fly through the tube substantially in a straight line, and improves the thrust. Defining the ion cyclotron frequency as $$f_{ICR} = q \cdot B_{max}/2\pi M$$

The ion are defined as unmagnetized if the ion cyclotron frequency is much smaller than the ion collision frequency (or the ion Hall parameter, which is their ratio, is lower than 1)

$$f_{ICR} << f_{ion\text{-}collision}$$

where q is the electric charge and M is the mass of the ions and $B_{max}$ the maximum value of the magnetic field. In this constraint, $f_{ICR}$ is the ion cyclotron resonance frequency, and is the frequency at which the ions gyrates around magnetic field lines; the constraint is representative of the fact that the gyration time in the chamber is so long, as compared to the collision period, that the movement of the ions is virtually not changed due to the magnetic field. $f_{ion\text{-}collision}$ is defined, as known per se, as $$f_{ion\text{-}collision} = N \cdot \sigma \cdot V_{TH}$$

where N is the volume density of electrons, σ is the electron-ion collision cross section and $V_{TH}$ is the electron thermal speed. The thermal speed can be express as $$V_{TH} = \sqrt{\frac{kT}{m_e}}$$

where k is the microscopic Boltzmann constant, T the temperature and $m_e$ the electron mass. $f_{ion\text{-}collision}$ is representative of the number of collisions that one ion has per second in a cloud of electrons having the density N and the temperature T.

Preferably, one would select the maximum value of the magnetic field so that $$f_{ICR} < f_{ion\text{-}collision}/2$$

or even $$f_{ICR} < f_{ion\text{-}collision}/10$$

Thus, the ion cyclotron resonance period in the thruster is at least twice longer than the collision period of the ions in the chamber, or in the thruster.

This is still possible, while have a sufficient confinement of the gas within the ionization volume of the thruster, as evidenced by the numerical example given below. The fact that the ions are mostly insensitive to the magnetic field first helps in focusing the ions and electrons beam the output of the thruster, thus increasing the throughput. In addition, this avoids that the ions remained attached to magnetic field lines after they leave the thruster; this ensure to produce net thrust.

The thruster further comprises an electromagnetic field generator, which generates an electromagnetic field in the chamber 6. In the example of FIG. 1, the electromagnetic field generator comprises a first resonant cavity 16 and a second resonant cavity 18, respectively located near the coils 12 and 14. The first resonant cavity 16 is adapted to generate an oscillating electromagnetic field in the cavity, between the two maxima of the magnetic field, or at least on the side of the maximum $B_{max2}$ containing the injector. The oscillating field is ionizing field, with a frequency $f_{E1}$ in the microwave range, that is between 900 MHz and 80 GHz. The frequency of the electromagnetic field is preferably adapted to the local value of the magnetic field, so that an important or substantial part of the ionizing is due to the electron cyclotron resonance. Specifically, for a given value $B_{res}$ of the magnetic field, the electron cyclotron resonance frequency $f_{ECR}$ is given by formula:

$$f_{ECR} = eB_{res}/2\pi m$$

with e the electric charge and m the mass of the electron. This value of the frequency of the electromagnetic field is adapted to maximize ionization of the propelling gas by electron cyclotron resonance. It is preferable that the value of the frequency of the electromagnetic field $f_{E1}$ is equal to the ECR frequency computed where the applied electromagnetic field is maximum. Of course, this is nothing but an approximation, since the intensity of the magnetic field varies along the axis and since the electromagnetic field is applied locally and not on a single point.

One may also select a value of the frequency which is not precisely equal to this preferred value; a range of ±10% relative to the ECR frequency is preferred. A range of ±5% gives better results. It is also preferred that at least 50% of the propelling gas is ionized while traversing the ionization volume or chamber. Such an amount of ionized gas is only made possible by using ECR for ionization; if the frequency of the electromagnetic field varies beyond the range of ±10% given above, the degree of ionization of the propelling gas is likely to drop well below the preferred value of 50%.

The direction of the electric component of the electromagnetic field in the ionization volume is preferably perpendicular to the direction of the magnetic field; in any location, the angle between the local magnetic field and the local oscillating electric component of the electromagnetic field is preferably between 60 and 90°, preferably between 75 and 90°. This is adapted to optimize ionization by ECR. In the example of FIG. 1, the electric component of the electromagnetic field is orthoradial or radial: it is contained in a plane perpendicular to the longitudinal axis and is orthogonal to a straight line of this plane passing through the axis; this may simply be obtained by selecting the resonance mode within the resonant cavity. In the example of FIG. 1, the electromagnetic field resonates in the mode $TE_{111}$. An orthoradial field also has the advantage of improving confinement of the plasma in the ionizing volume and limiting contact with the wall of the chamber. The direction of the electric component of the electromagnetic field may vary with respect to this preferred orthoradial direction; preferably, the angle between the electromagnetic field and the orthoradial direction is less than 45°, more preferably less than 20°.

In the acceleration volume, the frequency of the electromagnetic field is also preferably selected to be near or equal to the ECR frequency. This will allow the intensity of the magnetized ponderomotive force to be accelerating on both sides of the Electromagnetic field maximum, as shown in the second equation given above. Again, the frequency of the electromagnetic force need not be exactly identical to the ECR frequency. The same ranges as above apply, for the frequency and for the angles between the magnetic and electromagnetic fields. One should note at this stage that the frequency of the electromagnetic field used for ionization and acceleration may be identical: this simplifies the electromagnetic field generator, since the same microwave generator may be used for driving both resonant cavities.

Again, it is preferred that the electric component of the electromagnetic field be in the purely radial or orthoradial, so as to maximize the magnetized ponderomotive force. In addition, an orthoradial electric component of electromagnetic field will focus the plasma beam at the output of the thruster.

The angle between the electric component of the electromagnetic field and the radial or orthoradial direction is again preferably less than 45° or even better, less than 20°.

FIG. 2 is a diagram of the intensity of magnetic and electromagnetic fields along the axis of the thruster of FIG. 1; the intensity of the magnetic field and of the electromagnetic field is plotted on the vertical axis. The position along the axis of the thruster is plotted on the horizontal axis. As discussed above, the intensity of the magnetic field—which is mostly parallel to the axis of the thruster—has two maxima. The intensity of the electric component of the electromagnetic field has a first maximum $E_{max1}$ located in the middle plane of the first resonant cavity and a second maximum $E_{max2}$ located at the middle plane of the second resonant cavity. The value of the intensity of first maximum is selected together with the mass flow rate within the ionization chamber. The value of the second maximum may be adapted to the $I_{sp}$ needed at the output of the thruster. In the example of FIG. 2, the frequency of the first and second maxima of the electromagnetic field are equal: indeed, the resonant cavities are identical and are driven by the same microwave generator. In the example of FIG. 2, the origin along the axis of the thruster is at the nozzle of the injector.

The following values exemplify the invention. The flow of gas is 6 mg/s, the total microwave power is approximately 1550 W which correspond to ~350 W for ionisation and ~1200 W for acceleration for a thrust of about 120 mN. The microwave frequency is around 3 GHz. The magnetic field could then have an intensity with a maximum of about 180 mT and a minimum of ~57 mT. FIG. 2 also shows the value $B_{res}$ of the magnetic field, at the location where the resonant cavities are located. As discussed above, the frequency of the electromagnetic field is preferably equal to the relevant ECR frequency $eB_{res}/2\pi m$.

The following numerical values are exemplary of a thruster providing an ejection speed above 20 km/s and a density of thrust higher than 100 N/m$^2$. The tube is a tube of BN, having an internal diameter of 40 mm, an external diameter of 48 mm and a length of 260 mm. The injector is providing Xe, at a speed of 130 m/s when entering the tube, and with a mass flow rate of ~6 mg/s.

The first maximum of magnetic field $B_{max1}$ is located at $x_{B1}$=20 mm from the nozzle of the injector; the intensity $B_{max1}$ of the magnetic field is ~180 mT. The first resonant cavity for the electromagnetic field is located at $x_{E1}$=125 mm from the nozzle of the injector; the intensity $E_1$ of the magnetic field is ~41000 V/m. The second maximum of magnetic field $B_{max2}$ is located at $x_{B2}$=170 mm from the nozzle of the injector; the intensity $B_{max2}$ of this magnetic field is ~180 mT. The second resonant cavity for the electromagnetic field is located at $x_{E2}$=205 mm from the nozzle of the injector; the intensity $E_2$ of the magnetic field is ~77000 V/m.

About 90% of the gas passing into the acceleration volume ($x>x_{B2}$) is ionized. $f_{ICR}$ is 15,9 MHz, since q=e and M=130 amu. Thus, ion hall parameter is 0,2, so that the ions are mostly insensitive to the magnetic field. These values are exemplary. They demonstrate that the thruster of the invention makes it possible to provide at the same time an ejection speed higher than 15 km/s and a density of thrust higher than 100 N/m$^2$. In terms of process, the thruster of FIG. 1 operates as follows. The gas is injected within a chamber. It is then submitted to a first magnetic field and a first electromagnetic field, and is therefore at least partly ionized. The partly ionized gas then passes beyond the peak value of magnetic field. It is then submitted to a second magnetic field and a second electromagnetic field which accelerate it due to the magnetized ponderomotive force. Ionization and acceleration are separate and occur subsequently and are independently controllable.

The thruster exemplified above is therefore significantly more efficient than the devices of the prior art. It further has the following advantages. First, it does not have electrodes. Thus, all the problems created by such electrodes—erosion, high voltage and the like—are avoided. Second, thanks to the magnetized ponderomotive force, both electrons and ions are accelerated in the same direction. It is not necessary to provide a neutralizer at the output of the thruster.

Third, the same frequency of electromagnetic force is used for the ionization and the acceleration. This makes it possible to use the same microwave generator for driving the electromagnetic generator. Fourth, ionization and acceleration are separated, since they occur on opposite sides of a peak of the magnetic field. This makes it possible, as explained below, to act separately on the ionization and on the acceleration to adapt the performances of the thruster to the needs. It also increases the efficiency of ionization and decreases the energy necessary for ionizing the propelling gas.

Fifth, the electrons are energized and magnetized in the ionizing volume, but the ions are substantially insensitive to the magnetic field. This improves the efficiency of the thruster, as compared to the prior art VaSIMR thruster or to prior art plasma pumps. Also, the electrons are energized at the ECR frequency or near this frequency; this improves the efficiency of ionization.

FIG. 3 is a schematic view in cross-section of a thruster in a second embodiment of the invention. The example of FIG. 3 differs from the example of FIG. 1 in the position of the first resonant cavity 16, which is located near to the coil 14 producing the second maximum of the magnetic field. Specifically, the resonant cavity is located along the axis at a coordinate $x=x_{E3}$=205 mm. As represented on FIG. 2, this position is selected so that the value of the magnetic field at this position is identical to the value of the magnetic field at the position $x_{E1}$. This makes it possible to use the same resonant cavity, without having to adapt the value of the frequency of the electromagnetic field. One could also use two resonant cavities at the coordinates $x_{E1}$ and $x_{E2}$ for generating the electromagnetic field within the ionization volume. Again, this may improve the proportion of gas ionized within the ionization volume. Having the cavity on the right-hand side may diminish erosion.

Figure 5:
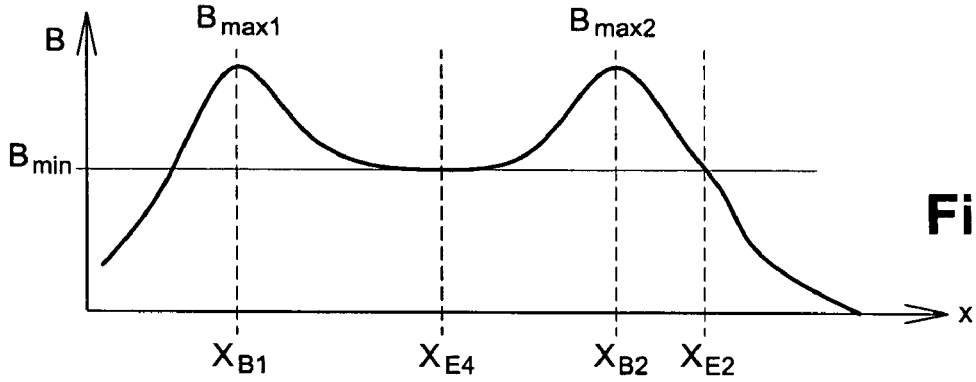
FIG. 5 is a diagram of the intensity of magnetic field along the axis of the thruster of FIG. 4.

FIG. 4 is a schematic view in cross a thruster in a third embodiment of the invention; FIG. 5 is a diagram of the intensity of magnetic and electromagnetic fields along the axis of the thruster of FIG. 4. The thruster of FIG. 4 is similar to the one of FIG. 1. However, the first resonant cavity 16 is located substantially in the middle of the coils 12 and 14. FIG. 5 is similar to FIG. 2, but shows the intensities of the magnetic field in the embodiment of FIG. 4. It shows that the first resonant cavity is located substantially at the coordinate $x_{E4}$, which corresponds to the minimum value $B_{min}$ of the magnetic field. The frequency of the electromagnetic field is selected to be $e.B_{min}/2\pi m$. The second resonant cavity is located at a position where the magnetic field has the same value. Again, this makes it possible to use the same microwave generator for driving both cavities. The advantage of the embodiment of FIGS. 4 and 5 is that the value of the magnetic field is substantially identical over the volume where the ECR field is applied. This increases the proportion of gas ionized, ceteris paribus.

Figure 6:
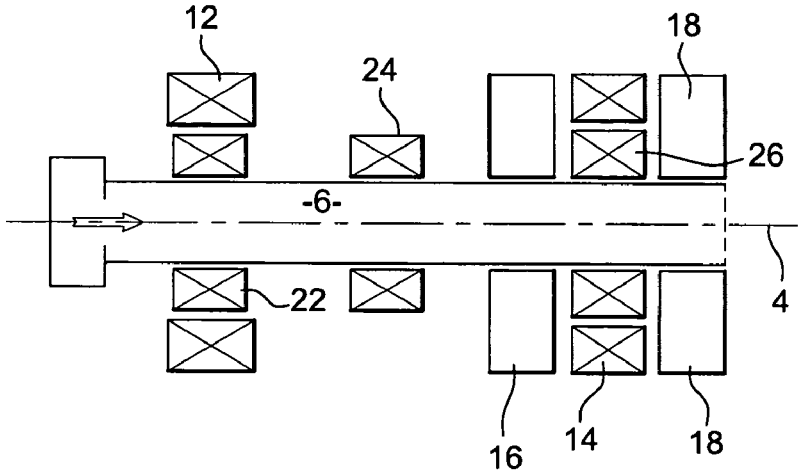
FIG. 6 is a schematic view in cross-section of a thruster in a fourth embodiment of the invention.
Figure 7:
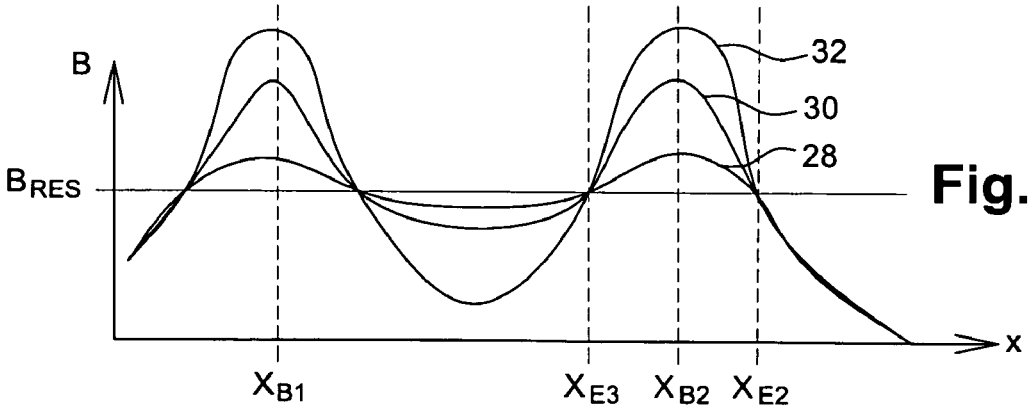
FIG. 7 is a diagram of the intensity of magnetic field along the axis of the thruster of FIG. 6.

FIG. 6 is a schematic view in cross a thruster in a fourth embodiment of the invention; FIG. 7 is a diagram of the intensity of magnetic field along the axis of the thruster of FIG. 6. In this embodiment, the values of the magnetic field mirror ratio may be adapted, so as to vary the degree of ionization within the ionization volume of the thruster. More specifically, increasing the degree of ionization will produce ions with a higher charge, due to increased confinements of the electrons within the ionization volume. These ions will gain a higher speed, thus increasing the total thrust.

The thruster of FIG. 6 is similar to the one of FIG. 3. However, the magnetic field generator is provided with three additional coils 22, 24 and 26. The first and third additional coils 22 and 26 are located within coils 12 and 14, while the second additional coil 24 is located substantially close to the middle of coils 12 and 14. The first and third additional coils produce a magnetic field reinforcing the field produced by coils 12 and 14. This makes it possible to increase the intensity of the maxima $B_{max1}$ and $B_{max2}$ of the magnetic field. The second additional coil produces a magnetic field opposed to the magnetic field provided by coils 12 and 14. This reduces the value $B_{min}$ of the magnetic field then increase the mirror ratio.

Figure 8:
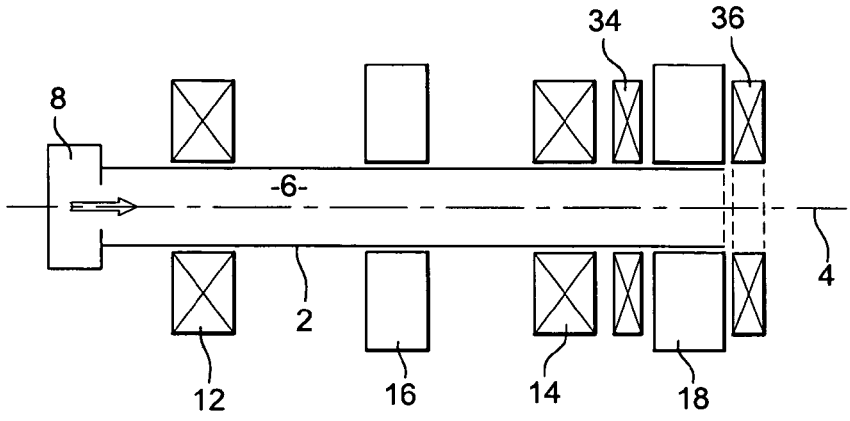
FIG. 8 is a schematic view in cross-section of a thruster in a fifth embodiment of the invention.
Figure 9:
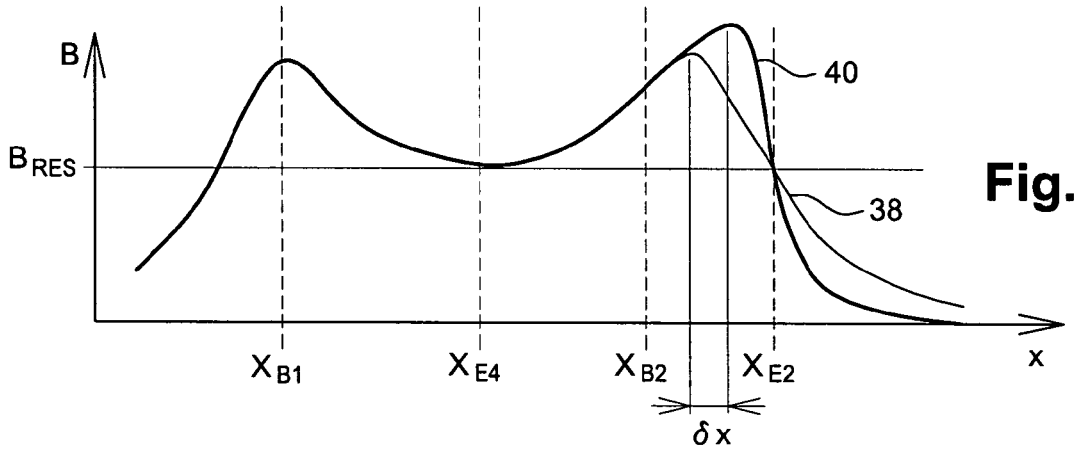
FIG. 9 is a diagram of the intensity of magnetic field along the axis of the thruster of FIG. 8.

FIG. 7 shows a graph of the intensity of the magnetic field for various values of the current applied to the additional coils. Graph 28 corresponds to the case where the additional coils are not producing any magnetic field. Graph 30 corresponds to a first value of current through additional coils, while graph 32 corresponds to a substantially higher value of current. Due to the presence of the second additional coil, the value of the magnetic field remains substantially identical at coordinates $x_{E3}$ and $x_{E2}$, where the resonant cavities are located. This avoids having to change the frequency of the electromagnetic field, or the position of the cavities, and ensures that the required ECR ionization is obtained irrespective of the value of the magnetic field. In other words, the maximum value of the magnetic field varies, but the value of the magnetic field remains substantially constant at the location of the resonant cavities. The value of the magnetic field varies in a range of 100%, thanks to these coils; this induces a change of up to 90% in the degree of ionization. This causes a change of up to 90% in the thrust. In this example, one may use additional coils at the output of the thrusters for modifying the profile and direction of the expelled material. FIG. 8 is a schematic view in cross a thruster in a fifth embodiment of the invention; FIG. 9 is a diagram of the intensity of magnetic field along the axis of the thruster of FIG. 9. In this embodiment, the gradient of the magnetic field may be adapted in the acceleration volume, so as to vary the intensity of the magnetized ponderomotive force. Indeed, as discussed above, the component of the magnetized ponderomotive force is proportional to the gradient of the magnetic field.

The thruster of FIG. 8 is similar to the one of FIG. 4; however, it further comprises additional gradient control coils 34, 36, located on both sides of the second resonant cavity 18. The first gradient coil 34, which is located between the second coil 14 and the second resonant cavity 18 generates a magnetic field parallel to the one generated by the second coil. The second gradient coil 36, which is located on the side of the second resonant cavity 18 opposite the second coil 14 generates a magnetic field opposed to the one generated by the second coil thus, these gradient control coils are adapted to vary the gradient of magnetic field in the acceleration volume of the thruster; in addition, they may be used to increase the maximum value of the magnetic field produced by the second coil while keeping the position of the resonant field close to the middle plane of the cavity The presence of the gradient control coils will slightly change the position of the resonant cavity in the acceleration volume of the thruster.

FIG. 9 shows a graph of the intensity of the magnetic field in the example of FIG. 8. Graph 38 corresponds to the case where the gradient control coils are not energized. Graph 40 shows the value of magnetic field when the gradient control coils are energized. The value of the gradient at the second resonant cavity 18 varies from 2,3 T/m to 4,5 T/m, that is a relative change of up to 100%. As in the example of FIG. 6, the value of the magnetic field at the resonant cavities remains constant and there is no need to change the frequency of the electric power driving the resonant cavities.

FIG. 9 further evidences that the position where the maximum value $B_{max2}$ of the magnetic field is reached is slightly offset when the gradient control coils are energized. The offset $\delta x$ is plotted on FIG. 9. This will change the length of the ionization chamber and together with the increase of the maximum value, will contribute to further ionize the propelling gas. Such further ionization, as explained in reference to FIGS. 6 and 7, increases the thrust.

Gradient control coils are those of FIG. 8 could also be used in the examples of FIGS. 1 and 4—the only constraint being the volume used by the coils. FIG. 8 is also a good example of a magnetic field generator extending beyond the end of the tube. This shows that the tube need not extend continuously from the injector to the end of the thruster. Gradient control coils may also be used in combination in the example of FIG. 7, again subject to the same constraint of volume.

Figure 10:
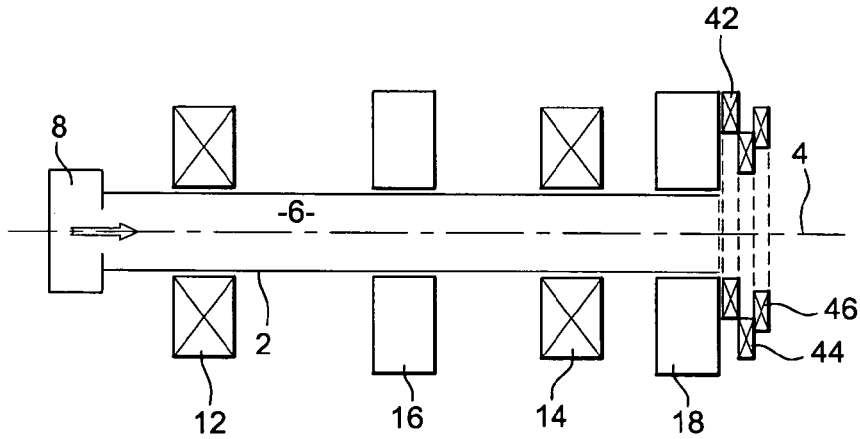
FIGS. 10 to 13 are schematic views of various embodiments of the thruster, which allow the direction of thrust to be changed.
Figure 11:
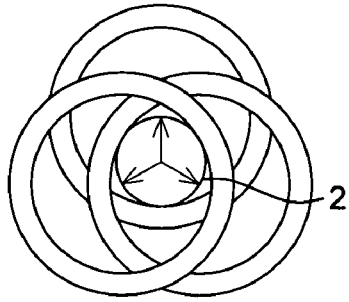

FIGS. 10 to 13 are schematic views of various embodiments of the thruster, which allow the direction of thrust to be changed. As discussed above, the ponderomotive force is directed along the lines of the magnetic field. Thus, changing the lines of this field in the accelerating volume of the thruster makes it possible to change the direction of thrust. FIG. 10 is a view in cross section of another embodiment of the thruster. The thruster is similar to the one of FIG. 4. However, in the example of FIG. 10, the thruster is further provided with three additional direction control coils 42, 44 and 46 located downstream of the second resonant cavity 18. These coils are offset with respect to the axis of the thruster, so as to change the direction of the magnetic field downstream of the second coil 14. FIG. 11 is a side view showing the three coils and the tube 2; it further shows the various magnetic fields that may be created by energizing one or several of these coils, which are represented symbolically by arrows within the tube 2. Preferably, the coils generate a magnetic field with a direction contrary to the one created by coils 12 and 14; this further increases the gradient of magnetic field, and therefore the thrust. On the other hand, energizing the coils with a reversible current makes it possible to vary the thrust direction over a broader range and use less coils (2 or 3 instead of 4) but use a more complex power supply to drive the coil.

Figure 12:
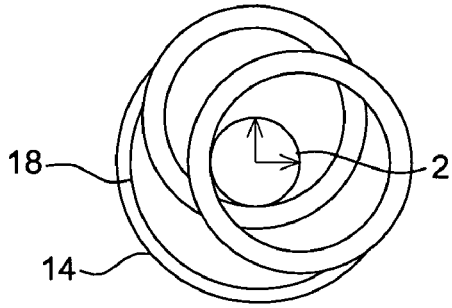
Figure 13:
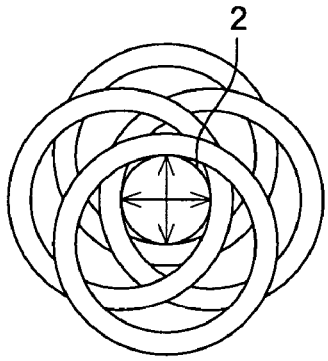

FIG. 12 is a side view similar to the one of FIG. 11, but in a thruster having only two additional coils; as compared to FIG. 11, in also shows the outer diameter of elements 14 and 18. FIG. 13 is a side view similar to the one of FIG. 11, but in a thruster having only four additional coils.

In the examples of FIGS. 10 to 13, the direction control coils are located as close as possible to the second cavity, so as to act on the magnetic field in the acceleration volume. It is advantageous that the intensity of the magnetic field in the direction control coils be selected so that the magnetic field still decreases continuously downstream of the thruster; this avoid any mirror effect that could locally trap the plasma electrons. One could also use coils the axis of which is inclined relative to the axis of the thruster. This may increase the possible range of directions for the thrust vector. The value of magnetic field created by the direction control coils is preferably from 20% to 80% of the main field, so that it nowhere reverses the direction of the magnetic field.

Figure 14:
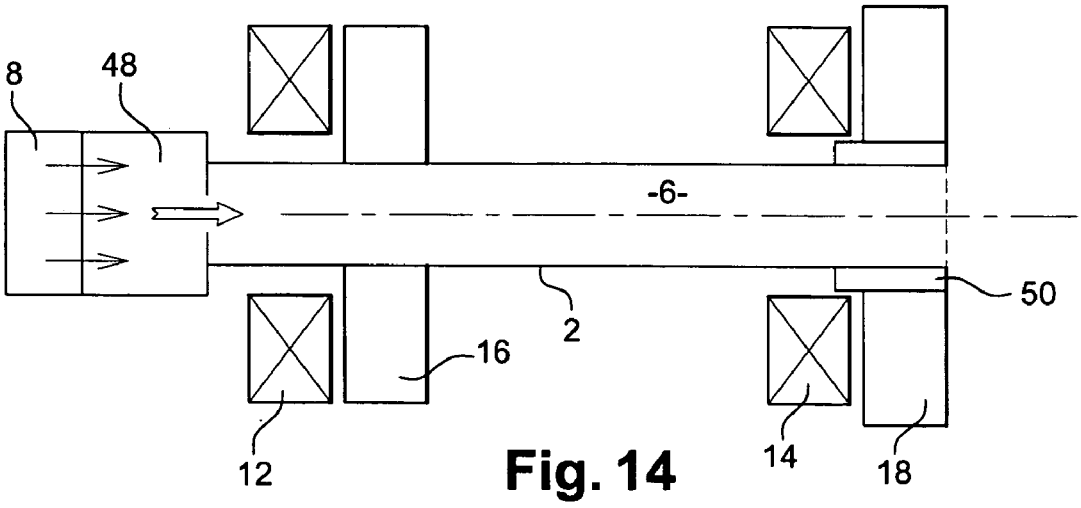
FIG. 14 is a schematic view in cross-section showing various possible changes in the tube.

FIG. 14 is a schematic view in cross-section showing various possible changes in the tube. These changes are combined in the example of FIG. 14, but they could be used separately in any of the embodiment of FIGS. 1 to 13 or in the embodiments of FIGS. 15 and 17. First, as compared to the embodiments discussed above, the chamber 6 of FIG. 14 has a smaller cross-section. This increases the density of gas in the chamber at the same mass flow rate and therefore the frequency of ionizing collision in the ionization volume. This improves ionization.

Second, the tube may be provided with a quieting chamber 48, located upstream of the chamber 6. This chamber has the advantage of protecting the injector nozzle against high energy electrons, which may pass beyond the barrier created by the first maximum $B_{max1}$ of magnetic field. In addition, such a quieting chamber will improve uniformity of the flow in the chamber and limit the gradient of density in the chamber. Third, the tube is further provided with an additional gas injector 50 inside the acceleration chamber. This protects the wall of the tube from erosion by the high energy electrons accelerated by the thruster.

Figure 15:
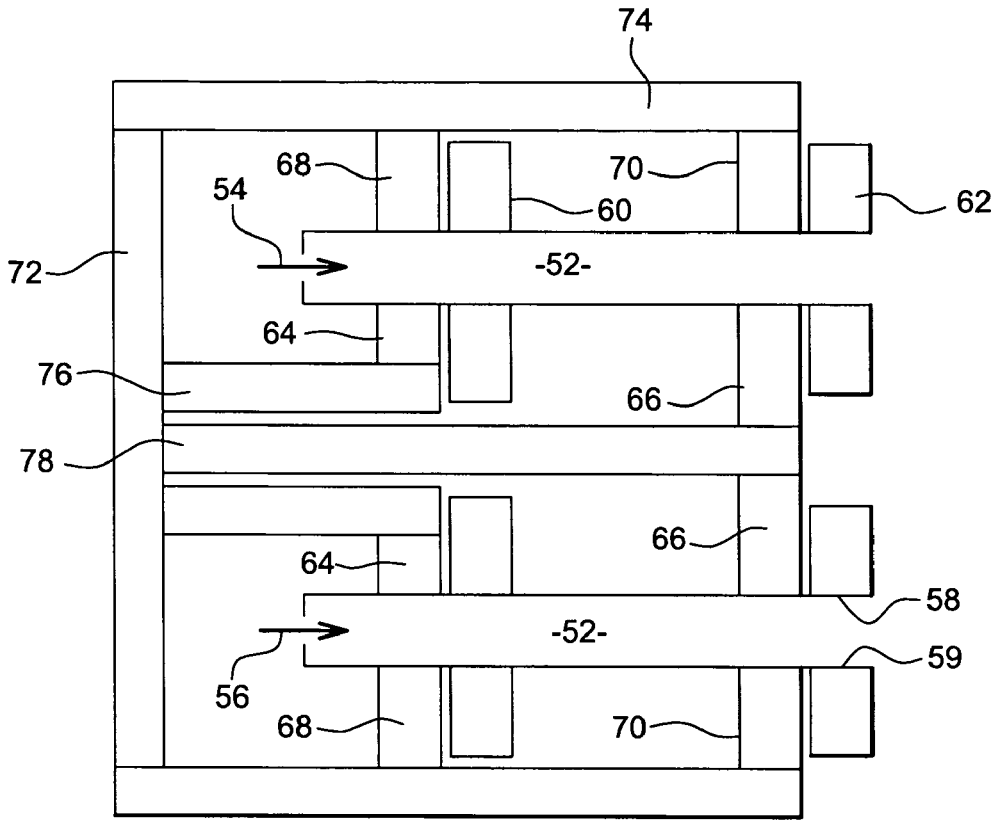
FIG. 15 is a schematic view in cross-section of a thruster in yet another embodiment of the invention.

FIG. 15 is a schematic cross section view of a thruster in yet another embodiment of the invention; in the example of FIG. 15, the chamber 52 is ring-shaped. In addition, the thruster of FIG. 15 uses permanent magnets instead of coils. The figure shows the chamber 52, with the injection of gas at one end (arrows 54 and 56). The tube thus comprises an inner cylinder 58 and an outer cylinder 59 arranged around the same axis. Injection of gas may actually be carried out around the ring forming the end of the chamber, with one or several injector (not represented on FIG. 15). First and second resonant cavities 60 and 62 are provided along the tube; each of the cavities is formed of an inner part located in the inside of the tube 58 and of an outer part located on the outside of the tube. The thruster of FIG. 15 uses permanent magnets. Two inner ring-shaped magnets 64 and 66 are provided inside of the cylinder 58; corresponding outer ring-shaped magnets 68 and 70 are outside of the outer cylinder 59, facing the inner ring-shaped magnets. A third magnet 72 is provided left of the chamber 52. It is circular in shape and extends substantially with the same outer diameter as the outer diameter of the outer ring-shaped magnets. For guiding magnetic field lines, a first circular tube in a material such as soft iron is provided outside of the outer ring-shaped magnets, and connects with the outer periphery of the circular magnet 72. A second circular tube 76 in a similar material is provided inside of the first inner ring-shaped magnet 64 and connects near to the center of circular magnet 72. A rod 78 guides magnetic field lines from the inner periphery of the second inner ring-shaped magnet 66 to the center of the circular magnet 78. Of course, other structures of the field line guides are possible.

Figure 16:
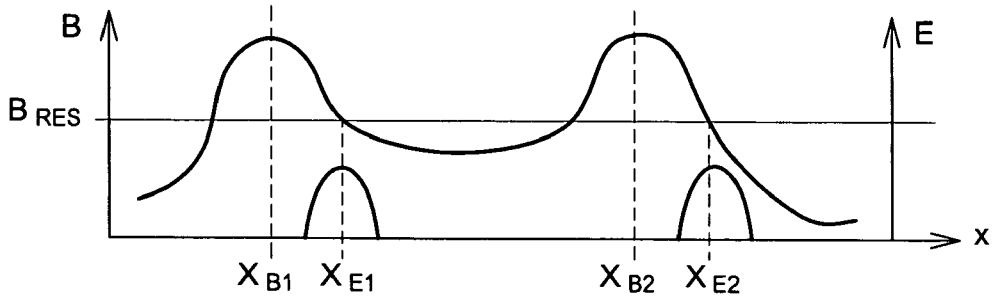
FIG. 16 is a diagram of the intensity of magnetic and electromagnetic fields along the axis of the thruster of FIG. 15.
Figure 17:
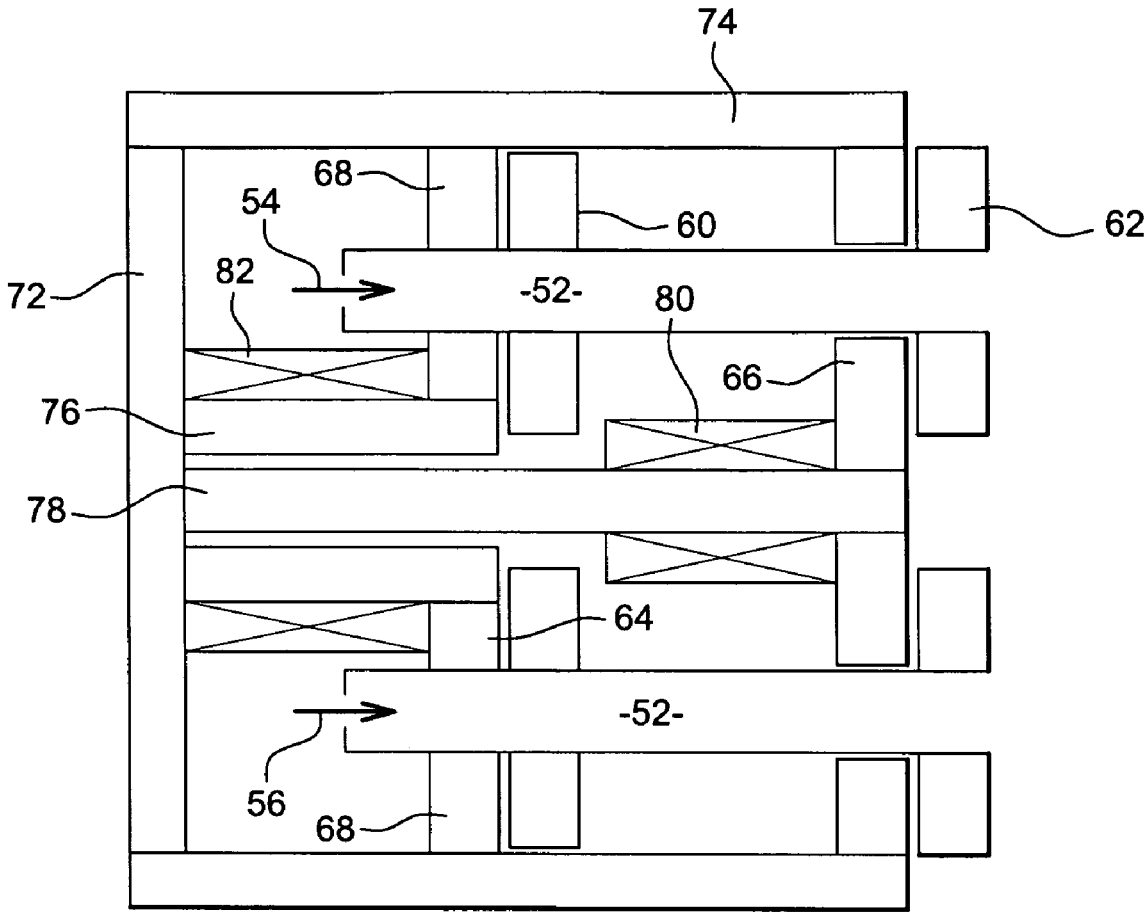
FIG. 17 is a schematic view in cross-section of yet another thruster.

FIG. 16 is a diagram of the intensity of magnetic and electromagnetic fields along the axis of the thruster of FIG. 15. It is substantially identical to the diagram of FIG. 2 except here the magnetic field is mostly radial. FIG. 17 is a schematic view of a thruster with a chamber 52 similar to the one of FIG. 15. However, the thruster of FIG. 17 uses coils for generating the magnetic field. The structure is similar to the one of FIG. 15, with the proviso that

- magnets 64, 66, 68, 70 and 72 are replaced by field line guiding means with substantially the same shape;
- a first ring-shaped coil 80 is provided on the outer diameter of the rod 78, near to the element 66;
- a second ring shaped coil 82 is provided on the outer diameter of the tube 76, near to the element 64.

Again, the magnetic and electromagnetic field are similar to the ones of FIG. 16. With a ring shaped chamber such as the one of FIGS. 15 and 17, the position of the magnetic field and electromagnetic field generators may easily be varied.

The following tables provide a number of examples of embodiments of the invention, numbered from 1-33. In these tables,

- Power is representative of the relative power of the thruster, compared to the other examples of the table;
- Band is the microwave frequency band;
- Ptotal is the total power of the thruster, in W;
- Pthrust is the thrust power, in W;
- Pion is the power used for ionization, in W;
- Thrust is the thrust obtained, in mN;
- Mdot is the mass flow rate, in mg/s;
- Isp is the specific impulse, that is the ratio between the exhaust velocity and gravity acceleration g at sea level, in s;
- Efficiency is the efficiency of the thruster, that is the ratio between the power used in the thruster and the mechanical thrust power;
- B is the resonant magnetic field, in mT;
- Fce is the electron cyclotron frequency, in GHz;
- $B_{max}/B_{min}$ is the ratio between the maximum and minimum values of the magnetic field;
- T/S is the density of thrust, in $N/m^2$:
- Routput is the radius of the thruster at the output, in cm;
- Rin is the internal radius of the magnetic coils, in cm;
- L is the total length of the cavity, in cm;
- Dbob is the distance between the magnetic coils, in cm;
- Ibob is the intensity in the magnetic coils, in A;
- Nbob is the number of turn in the coils.

The various examples provide ranges for each or the exemplified values. For instance, the value of the ratio Bmax/Bmin is between 1.69 (examples 18 and 24) and 17.61 (example 5). The value should preferably be comprised between 1,2 and 20. Although the various ranges derivable from the table are related to specific examples, the invention is workable within the full range provided in the table. Thus, the various ranges derived from the table are actually independent one from another.

TABLE 1

| Ex | Power | Band | Ptotal | Pthrust | Pion | Thrust |
|---|---|---|---|---|---|---|
| 1 | Low | C | 199 | 190 | 9 | 8.3 |
| 2 | Low | X | 200 | 139 | 48 | 16.4 |
| 3 | Low | K | 200 | 152 | 48 | 17.2 |
| 4 | Low | X | 200 | 124 | 7 | 5.9 |
| 5 | Low | K | 200 | 151 | 7 | 6.6 |
| 6 | Low | C | 224 | 163 | 61 | 20.0 |
| 7 | Medium Low | K | 1500 | 968 | 382 | 122.1 |
| 8 | Medium Low | C | 1500 | 1117 | 382 | 131.1 |
| 9 | Medium Low | X | 1500 | 1117 | 382 | 131.1 |
| 10 | Medium Low | C | 1500 | 993 | 61 | 49.3 |
| 11 | Medium Low | X | 1500 | 1392 | 61 | 58.4 |
| 12 | Medium Low | K | 1500 | 1392 | 61 | 58.4 |
| 13 | Medium | K | 3500 | 2591 | 897 | 306.2 |
| 14 | Medium | C | 3500 | 2599 | 897 | 306.7 |
| 15 | Medium | X | 3500 | 2929 | 574 | 260.5 |
| 16 | Medium | K | 3500 | 2947 | 143 | 130.2 |
| 17 | Medium | X | 3500 | 3368 | 143 | 139.2 |
| 18 | Medium | C | 3500 | 3369 | 143 | 139 |
| 19 | Medium High | K | 8000 | 7061 | 913 | 510.0 |
| 20 | Medium High | X | 8000 | 7355 | 670 | 445.8 |
| 21 | Medium High | X | 8000 | 7604 | 329 | 317.4 |
| 22 | Medium High | K | 8000 | 7691 | 329 | 319.2 |
| 23 | Medium High | C | 8000 | 7699 | 329 | 319.4 |
| 24 | Medium High | C | 8027 | 7708 | 319 | 315.1 |
| 25 | High | C | 10000 | 7417 | 2573 | 877.3 |

TABLE 1-continued

| Ex | Power | Band | Ptotal | Pthrust | Pion | Thrust |
|---|---|---|---|---|---|---|
| 26 | High | K | 10000 | 9089 | 839 | 554.6 |
| 27 | High | X | 10000 | 9612 | 410 | 398.9 |
| 28 | High | C | 10000 | 9623 | 410 | 399.1 |
| 29 | High | K | 10000 | 9686 | 339 | 364.0 |
| 30 | Very High | C | 50000 | 45952 | 4204 | 2791.4 |
| 31 | Very High | C | 50000 | 48106 | 2059 | 1998.9 |
| 32 | Very High | X | 50000 | 49319 | 804 | 1264.9 |
| 33 | Very High | K | 50000 | 49349 | 712 | 1190.8 |

TABLE 2

| Ex | Mdot | Isp | Efficacité | B | Fce | Bmin/Bmax | T/S |
|---|---|---|---|---|---|---|---|
| 1 | 0.18 | 4638 | 75.97% | 85.41 | 2.391 | 2.16 | 26.6 |
| 2 | 0.97 | 1729 | 69.63% | 344.97 | 9.656 | 2.16 | 52.3 |
| 3 | 0.97 | 1806 | 75.96% | 634.46 | 17.759 | 9.79 | 54.6 |
| 4 | 0.14 | 4244 | 61.83% | 352.09 | 9.855 | 2.16 | 75.6 |
| 5 | 0.14 | 4684 | 75.34% | 649.72 | 18.186 | 17.61 | 83.5 |
| 6 | 1.22 | 1666 | 65.35% | 85.41 | 2.391 | 2.16 | 63.6 |
| 7 | 7.70 | 1617 | 64.56% | 634.46 | 17.759 | 9.79 | 388.6 |
| 8 | 7.70 | 1737 | 74.47% | 88.55 | 2.479 | 2.26 | 104.3 |
| 9 | 7.70 | 1737 | 74.47% | 338.73 | 9.481 | 3.75 | 104.3 |
| 10 | 1.22 | 4108 | 66.23% | 88.55 | 2.479 | 2.26 | 39.2 |
| 11 | 1.22 | 4864 | 92.82% | 634.46 | 17.759 | 9.79 | 185.8 |
| 12 | 1.22 | 4864 | 92.82% | 634.46 | 17.759 | 9.79 | 743.1 |
| 13 | 18.09 | 1725 | 74.02% | 634.46 | 17.759 | 9.79 | 974.6 |
| 14 | 18.09 | 1728 | 74.27% | 88.55 | 2.479 | 2.26 | 79.7 |
| 15 | 11.58 | 2293 | 83.69% | 338.73 | 9.481 | 3.75 | 207.3 |
| 16 | 2.87 | 4616 | 84.19% | 634.46 | 17.759 | 9.79 | 414.3 |
| 17 | 2.87 | 4935 | 96.23% | 338.73 | 9.481 | 3.75 | 442.9 |
| 18 | 2.87 | 4935 | 96.26% | 105.78 | 2.961 | 1.69 | 110.8 |
| 19 | 18.42 | 2823 | 88.26% | 634.46 | 17.759 | 9.79 | 1623.3 |
| 20 | 13.51 | 3363 | 91.93% | 338.73 | 9.481 | 3.75 | 354.8 |
| 21 | 6.63 | 4884 | 95.06% | 338.73 | 9.481 | 3.75 | 449.1 |
| 22 | 6.63 | 4911 | 96.13% | 634.46 | 17.759 | 9.79 | 1016.2 |
| 23 | 6.63 | 4914 | 96.23% | 88.55 | 2.479 | 2.26 | 162.7 |
| 24 | 6.44 | 4986 | 96.34% | 90.30 | 2.528 | 1.69 | 111.5 |
| 25 | 51.89 | 1724 | 74.17% | 88.55 | 2.479 | 2.26 | 137.9 |
| 26 | 16.92 | 3341 | 90.89% | 634.46 | 17.759 | 9.79 | 1765.4 |
| 27 | 8.28 | 4913 | 96.12% | 338.73 | 9.481 | 3.75 | 564.3 |
| 28 | 8.28 | 4915 | 96.23% | 88.55 | 2.479 | 2.26 | 203.3 |
| 29 | 6.84 | 5425 | 96.86% | 634.46 | 17.759 | 9.79 | 1158.6 |
| 30 | 84.78 | 3356 | 91.90% | 86.62 | 2.425 | 4.45 | 246.8 |
| 31 | 41.53 | 4906 | 96.21% | 86.62 | 2.425 | 4.45 | 360.7 |
| 32 | 16.22 | 7949 | 98.64% | 338.73 | 9.481 | 3.75 | 1006.6 |
| 33 | 14.37 | 8449 | 98.70% | 634.46 | 17.759 | 9.79 | 3790.4 |

TABLE 3

| Ex | Routput | Rin | L | Dbob | Ibob | Nbob |
|---|---|---|---|---|---|---|
| 1 | 1 | 8 | 32 | 20 | 1 | 15000 |
| 2 | 1 | 4 | 17 | 10 | 1.35 | 20000 |
| 3 | 1 | 2 | 16 | 10 | 1.4 | 20000 |
| 4 | 0.5 | 4 | 18 | 10 | 1.5 | 20000 |
| 5 | 0.5 | 1.6 | 16 | 10 | 1.35 | 20000 |
| 6 | 1 | 8 | 32 | 20 | 1 | 15000 |
| 7 | 1 | 2 | 16 | 10 | 1.4 | 20000 |
| 8 | 2 | 7 | 30 | 18 | 1 | 15000 |
| 9 | 2 | 3 | 17 | 10 | 1.2 | 20000 |
| 10 | 2 | 7 | 30 | 18 | 1 | 15000 |
| 11 | 1 | 2 | 16 | 10 | 1.4 | 20000 |
| 12 | 0.5 | 2 | 16 | 10 | 1.4 | 20000 |
| 13 | 1 | 2 | 16 | 10 | 1.4 | 20000 |
| 14 | 3.5 | 7 | 30 | 18 | 1 | 15000 |
| 15 | 2 | 3 | 17 | 10 | 1.2 | 20000 |
| 16 | 1 | 2 | 16 | 10 | 1.4 | 20000 |
| 17 | 1 | 3 | 17 | 10 | 1.2 | 20000 |
| 18 | 2 | 7 | 26 | 15 | 1 | 15000 |
| 19 | 1 | 2 | 16 | 10 | 1.4 | 20000 |
| 20 | 2 | 3 | 17 | 10 | 1.2 | 20000 |
| 21 | 1.5 | 3 | 17 | 10 | 1.2 | 20000 |

TABLE 3-continued

| Ex | Routput | Rin | L | Dbob | Ibob | Nbob |
|---|---|---|---|---|---|---|
| 22 | 1 | 2 | 16 | 10 | 1.4 | 20000 |
| 23 | 2.5 | 7 | 30 | 18 | 1 | 15000 |
| 24 | 3 | 7 | 27 | 15 | 1 | 15000 |
| 25 | 4.5 | 7 | 30 | 18 | 1 | 15000 |
| 26 | 1 | 2 | 16 | 10 | 1.4 | 20000 |
| 27 | 1.5 | 3 | 17 | 10 | 1.2 | 20000 |
| 28 | 2.5 | 7 | 30 | 18 | 1 | 15000 |
| 29 | 1 | 2 | 16 | 10 | 1.4 | 20000 |
| 30 | 6 | 5 | 30 | 18 | 1 | 15000 |
| 31 | 4.2 | 5 | 30 | 18 | 1 | 15000 |
| 32 | 2 | 3 | 17 | 10 | 1.2 | 20000 |
| 33 | 1 | 2 | 16 | 10 | 1.4 | 20000 |

The examples given above may be adapted and varied. For instance, one could use means other than coils for generating the magnetic field, such as permanent magnets, as exemplified in FIG. 15; this applies also the other thrusters. The number of resonant cavities or coils may be varied according to the needs. For instance, one could use a single resonant cavity for generating the electromagnetic field on both sides of the maximum of the magnetic field, subject to volume constraints. In the example of FIGS. 6 and 7, one uses three additional coils: the number of additional coils as well as their positions could be different; one could for instance add and additional coil in the acceleration volume of the thruster. One could also use such additional coils in the embodiments of FIGS. 1, 3, 4, 8 10, 14, 15 or 16. Similarly, the number of gradient control coils as well as their positions could be different from the example of FIG. 8; one may use gradient coils in the other examples. One could also permanently create a higher gradient of magnetic field—as in graph 40 of FIG. 9. Direction control coils such as those of FIGS. 10-13 could also be used in the embodiments of FIGS. 1 to 9 or 15 and 17. In all examples, the same frequency can be used for the ionizing and accelerating electromagnetic fields; this simplifies the generation of the electromagnetic field; however, one could also use different frequencies from different generators.

The invention claimed is:

1. A thruster comprising:

a chamber defining an axis of thrust;

an injector adapted to inject ionizable gas within the chamber;

a magnetic field generator adapted to generate a magnetic field, said magnetic field having at least a maximum along the axis;

an electromagnetic field generator adapted to generate:

a microwave ionizing field in the chamber, on one side of said maximum; and a magnetized pondermotive accelerating field on the other side of said maximum.

2. The thruster of claim 1, wherein the angle of the magnetic field with the axis is less than 45°.

3. The thruster of claim 2, wherein the angle of the magnet field with the axis is less than 20°.

4. The thruster of claim 1, wherein the ion cyclotron resonance period in the thruster is at least one order of magnitude higher than the transit time of the ions in the thruster.

5. The thruster of claim 1, wherein the ratio of the maximum value to the minimum value of the magnetic field is between 2 and 20.

6. The thruster of claim 1, wherein the angle of the electromagnetic field with the orthoradial direction is less than 45°.

7. The thruster of claim 6, wherein the angle of the electromagnetic field with the orthoradlal direction is less than 20°.

8. The thruster of claim 1, wherein the local angle between the electromagnetic field and the magnetic field in the thruster is between 60 and 90°.

9. The thruster of claim 1, wherein the frequency of the electromagnetic field is within 10% of the electron cyclotron resonance frequency at the location where the electromagnetic field is generated.

10. The thruster of claim 1, wherein the microwave ionizing field and the magnetic field are adapted to ionize at least 50% of the gas injected in the chamber.

11. The thruster of claim 1, wherein the magnetic field generator comprises at least one coil located along the axis substantially at the maximum of magnetic field.

12. The thruster of claim 11, wherein the magnetic field generator comprises a second coil located between said at least one coil and said injector.

13. The thruster of claim 1, wherein the magnetic field generator is adapted to vary the value of said maximum.

14. The thruster of claim 1, wherein the magnet field generator is adapted to vary the direction of said magnetic field, at least on said other side of said maximum.

15. The thruster of claim 14, wherein the magnetic field generator comprises at least two direction control coils.

16. The thruster of claim 15, wherein the direction control coils are located downstream a resonant cavity located on said other side of said maximum.

17. The thruster of claim 15, wherein the direction control coils are offset with respect to the axis of the thruster.

18. The thruster of claim 15, wherein the direction control coils are energized with a reversible current.

19. The thruster of claim 15, wherein the direction control coils create a magnetic field having an intensity which is comprised between 20% to 80% of the magnetic field generated by the magnetic field generator.

20. The thruster of claim 19, wherein the intensity of the magnetic field created by the direction control coils decreases continuously downstream of the thruster's axis.

21. The thruster of claim 1, wherein the electromagnetic field generator comprises at least one resonant cavity.

22. The thruster of claim 1, wherein the electromagnetic field generator comprises at least one resonant cavity on said one side of said maximum.

23. The thruster of claim 1, wherein the electromagnetic field generator comprises at least one resonant cavity on said other side of said maximum.

24. The thruster of claim 1, wherein the chamber is formed within a tube.

25. The thruster of claim 24, wherein the tube has an increased section at its end opposite the injector.

26. The thruster of claim 24, wherein the tube is provided with a radioactive isotope.

27. The thruster of claim 1, further comprising a quieting chamber between the injector and the chamber.

28. A thruster comprising:

a chamber defining an axis of thrust;

an injector adapted to inject ionizable gas within the chamber;

a magnetic field generator adapted to generate a magnetic field, and magnetic field having at least a maximum along the axis;

an electromagnetic field generator adapted to generate:

a microwave ionizing field in the chamber, on one side of said maximum; and a magnetized ponderomotive accelerating field on the other side of said maximum;

wherein the ion cyclotron resonance period in the thruster is at least one order of magnitude higher than the transit time of the ions in the thruster.

29. The thruster of claim 28, wherein the frequency of the electromagnetic field is within 10% of the electron cyclotron resonance frequency at the location where the electromagnetic field is generated.

* * * * *

UNITED STATES PATENT AND TRADEMARK OFFICE

CERTIFICATE OF CORRECTION

PATENT NO. : 7,461,502 B2
APPLICATION NO. : 11/230129
DATED : December 9, 2008
INVENTOR(S) : Gregory Emsellem It is certified that error appears in the above-identified patent and that said Letters Patent is hereby corrected as shown below:

On the title page, item [63]: under the heading "Related U.S. Application Data", after "Mar. 17, 2004" please add --, which claims priority to European Application No. EP 03290712.3, filed March 20, 2003--

Signed and Sealed this

Twenty-fourth Day of March, 2009

JOHN DOLL
*Acting Director of the United States Patent and Trademark Office*